US009901764B2

(12) United States Patent
Popp et al.

(10) Patent No.: US 9,901,764 B2
(45) Date of Patent: Feb. 27, 2018

(54) DEVICE, SYSTEM, AND METHOD FOR SUPPLYING FIRE SUPPRESSING AGENT TO THE INTERIOR OF A CONTAINER FOR AN EXTENDED DURATION

(71) Applicants: James B. Popp, Olive Branch, MS (US); Joseph May, Germantown, TN (US)

(72) Inventors: James B. Popp, Olive Branch, MS (US); Joseph May, Germantown, TN (US)

(73) Assignee: Federal Express Corporation, Memphis, TN (US)

( * ) Notice: Subject to any disclaimer, the term of this patent is extended or adjusted under 35 U.S.C. 154(b) by 307 days.

(21) Appl. No.: 14/656,014

(22) Filed: Mar. 12, 2015

(65) Prior Publication Data

US 2015/0258358 A1 Sep. 17, 2015

Related U.S. Application Data

(60) Provisional application No. 61/952,503, filed on Mar. 13, 2014.

(51) Int. Cl.

| | |
|---|---|
| ***A62C 3/00*** | (2006.01) |
| ***A62C 37/44*** | (2006.01) |
| ***A62C 3/08*** | (2006.01) |
| ***A62C 31/22*** | (2006.01) |
| *A62C 3/07* | (2006.01) |
| *A62C 3/10* | (2006.01) |

(52) U.S. Cl.

CPC ..... *A62C 37/44* (2013.01); *A62C 3/08* (2013.01); *A62C 31/22* (2013.01); *A62C 3/07* (2013.01); *A62C 3/10* (2013.01)

(58) Field of Classification Search

CPC ..... A62C 3/08; A62C 31/22; A62C 37/44; A62C 3/07; A62C 3/10; A62C 35/023

See application file for complete search history.

(56) References Cited

U.S. PATENT DOCUMENTS 4,625,808 A * 12/1986 Halfpenny ..... A62C 31/22 169/30

4,643,260 A 2/1987 Miller (Continued)

OTHER PUBLICATIONS

PCT International Search Report dated Jun. 15, 2015, in Int'l Application No. PCT/US15/20194.

*Primary Examiner* — Jason Boeckmann

(74) *Attorney, Agent, or Firm* — Finnegan, Henderson, Farabow, Garrett & Dunner, L.L.P.

(57) ABSTRACT

A device for supplying fire suppressing agent to the interior of a container for an extended duration may include a plurality of chambers configured to contain and selectively expel the fire suppressing agent, a puncture mechanism configured to puncture a container, and a manifold in flow communication with the plurality of chambers and the puncture mechanism. The device may further include a controller configured to initiate expulsion of the fire suppressing agent from the chambers in a controlled manner, where the device is configured such that the fire suppressing agent may be first expelled from a first one of the plurality of chambers at a first time, and the fire suppressing agent may be expelled from a second one of the plurality of chambers at a second time that is later than the first time.

23 Claims, 12 Drawing Sheets

(56) References Cited

U.S. PATENT DOCUMENTS

| | | | | |
|---|---|---|---|---|
| 4,779,683 | A * | 10/1988 | Enk | A62C 35/08<br>169/28 |
| 2008/0149352 | A1 | 6/2008 | Lund et al. | |
| 2010/0012335 | A1 | 1/2010 | Popp | |

* cited by examiner

DEVICE, SYSTEM, AND METHOD FOR SUPPLYING FIRE SUPPRESSING AGENT TO THE INTERIOR OF A CONTAINER FOR AN EXTENDED DURATION

RELATED APPLICATION

This application claims the benefit of priority under 35 U.S.C. § 119(e) of U.S. Provisional Application No. 61/952,503, filed Mar. 13, 2014, the disclosure of which is incorporated herein by reference.

FIELD OF THE DISCLOSURE

The present disclosure relates to systems and methods for suppressing fires. In particular, the present disclosure relates to systems and methods for suppressing fires associated with containers.

BACKGROUND OF THE DISCLOSURE

Cargo may be transported to its destination using one or more of several different types of vehicles, including, for example, ships, trains, aircraft, and trucks. Such cargo is transported while located in the interior of cargo areas. In some cases, cargo may include hazardous, easily flammable, and/or easily combustible materials that may render transport dangerous to the cargo itself, as well as to the vehicle transporting the cargo and operators of the vehicle.

In many instances, cargo may be carried in an area separated from an operator controlling the vehicle. As a result, an operator may be unaware of a fire or explosion that has occurred within a cargo container or within the cargo area. Moreover, due to the nature of a cargo vehicle, there may be a limited supply of fire suppressant available. For example, aboard a cargo aircraft, the weight of any fire suppressant may limit the amount of fire suppressant that may be carried for suppressing fires. Therefore, it may be desirable to limit the amount of fire suppressant used to extinguish a fire in order to reduce the weight carried by the aircraft by focusing any release of fire suppressant on the particular area in need of fire suppressant, rather than merely releasing a large enough amount of suppressant to flood the entire cargo area. Furthermore, the fire suppressant itself may be harmful to some types of cargo. Therefore, it may be desirable to limit the release of fire suppressant to the location in need of fire suppression, so as to limit the spoilage of cargo not in need of fire suppressant.

Because cargo areas experiencing a fire may be located remotely from cargo vehicle operators (i.e., the cargo may be located in an unoccupied and/or difficult to access portion of the vehicle), it may be more difficult to provide fire suppressant to an area experiencing a fire in a timely manner. Therefore, it may be desirable to provide a system for supplying fire suppressant remotely and in a timely manner.

One example of a cargo vehicle having an operator located relatively remotely from the cargo area is an aircraft. The majority of cargo carried by modern aircraft is transported in cargo containers or on cargo pallets. The containers are generally referred to generically as Unit Load Devices ("ULDs"). For safety considerations, ULDs must often be configured to engage an aircraft cargo locking system in order to restrain the cargo containers under various flight, ground load, and/or emergency conditions. Under federal air regulations, ULDs are considered aircraft appliances, are Federal Aviation Administration (FAA)-certified for a specific type of aircraft, and are typically manufactured to specifications contained in National Aerospace Standard (NAS) 3610.

In the cargo aircraft example, while some cargo areas may be conventionally equipped with fire extinguishing bottles intended for manual operation, few cargo containers may be accessible to flight crews during a flight, thereby possibly rendering it difficult to manually extinguish a fire located in an aircraft cargo area using fire extinguishing bottles. In addition, fires may occur inside cargo containers, and if those fires are not suppressed or extinguished, they may breach the walls of the container and spread throughout the cargo area. However, it may be difficult, if not impossible, to suppress or extinguish a fire inside a container without discharging fire suppressant into the interior of the container.

Thus, it may be desirable to provide a system for suppressing a fire associated with a container for which a fire has been detected. In addition, it may be desirable to provide a system for supplying fire suppressant inside the container. Further, it may be desirable to provide a system for supplying a fire suppressant inside the container for an extended period of time or duration of time, for example, so that a cargo aircraft may safely land before a fire spreads throughout the cargo area.

Such a fire suppression system or plurality of systems may be located either in one area of a cargo area, such as a "high risk" area containing particularly hazardous materials, or throughout the cargo area.

Problems associated with detecting and/or suppressing fires are not limited to the cargo transportation industry. Similar problems may arise, for example, wherever cargo and/or other articles are stored in a location that is remote from a person supervising the cargo or other articles, such as in a storage facility. Thus, in a broad variety of situations, it may be desirable to remotely detect and/or remotely suppress a fire.

In many applications, it may be impractical or inefficient to store a fire suppression system directly in a container such as a ULD. For instance, containers may be subjected to harsh environments, including extreme cold and heat, shock, vibration, and general abuse. As a result, providing a fire suppression system in each individual container may be impractical due, for example, to accelerated degradation or failure of such systems over time. Moreover, a given company in the cargo freight industry may use thousands of containers, and the cost of equipping each container with a fire suppression system may be prohibitive. Installing, maintaining, and removing the fire suppression system of each container could also be impractical and uneconomical. As a result, there are many possible drawbacks to providing fire suppressing systems in a large number of containers.

In addition, existing technologies and techniques may only provide a limited fire suppressing window. For example, some methods may be a one-time solution, such as devices that supply a fire suppressing agent into a container during a single application. When a fire suppressing agent leaks out of or disperses from a ULD after introduction into the ULD, the fire may grow again and breach the ULD, potentially spreading to surrounding cargo. This may severely limit the time available for a flight crew to safely land a cargo aircraft, for example. Some tests have shown that a single application of fire suppressing agent into a container may be effective for twenty minutes or less. This may be inadequate, for example, for a cargo aircraft during a transoceanic flight, where it may take several hours to fly to the closest airport suitable for landing. Therefore, it may be desirable to provide a consistent or repeated supply of fire suppressing agent to a container over an extended duration.

SUMMARY

In the following description, certain aspects and embodiments of a device for supplying fire suppressing agent to the interior of a container for an extended duration will become evident. It should be understood that the aspects and embodiments, in their broadest sense, could be practiced without having one or more features of these aspects and embodiments. It should be understood that these aspects and embodiments are merely exemplary.

One aspect of the disclosure relates to a device for supplying fire suppressing agent to the interior of a container for an extended duration. The device may include a plurality of chambers configured to contain and selectively expel fire suppressing agent, a puncture mechanism configured to puncture a container, and a manifold in flow communication with the plurality of chambers and the puncture mechanism. The device may further include a controller configured to initiate expulsion of the fire suppressing agent from the chambers in a controlled manner. The device may be configured such that the fire suppressing agent may be first expelled from a first one of the plurality of chambers at a first time, and the fire suppressing agent may be expelled from a second one of the plurality of chambers at a second time that is later than the first time.

As used herein, the term "fire" is not necessarily limited to a fire having visible flames. Rather, the term "fire" is used in a broad sense and may be used to describe situations in which an object and/or surface is exhibiting a higher temperature than desired or considered to be unsafe to a person having skill in the art, such as, for example, a situation in which an object and/or surface is smoldering, smoking, and/or is hot to the touch.

According to another aspect, a system for supplying fire suppressing agent to the interior of a container for an extended duration may include a plurality of chambers configured to contain and selectively expel fire suppressing agent, a puncture mechanism configured to puncture a container, and a manifold in flow communication with the plurality of chambers and the puncture mechanism. The system may further include a sensor configured to provide signals indicative of a temperature associated with a container to a controller configured to initiate expulsion of fire suppressing agent from the chambers in a controlled manner. The system may be configured such that the fire suppressing agent may be first expelled from a first one of the plurality of chambers at a first time, and the fire suppressing agent may be expelled from a second one of the plurality of chambers at a second time that is later than the first time. The puncture mechanism may be configured to extend and puncture a container after expulsion of the fire suppressing agent.

According to a further aspect, a method for supplying fire suppressing agent to the interior of a container for an extended duration may include detecting sensor signals indicative of a temperature associated with a container, determining via a controller that the fire suppressing agent should be supplied to the interior of the container based at least in part on the sensor signals, and initiating via the controller expulsion of fire suppressing agent from a chamber containing fire suppressing agent. The method may further include puncturing a surface of the container with a puncture mechanism to provide flow communication between the chamber and the interior of the container to permit supply of fire suppressing agent into the interior of the container at a first time. The method may further include initiating, via the controller, expulsion of fire suppressing agent from a second chamber containing fire suppressing agent at a second time after the first time. The method may further include supplying fire suppressing agent from the second chamber into the interior of the container.

It is to be understood that both the foregoing general description and the following detailed description are exemplary and explanatory only and are not restrictive of the invention, as claimed.

The accompanying drawings, which are incorporated in and constitute a part of this specification, illustrate several exemplary embodiments and together with the description, may serve to explain the principles of the disclosure.

DESCRIPTION OF EXEMPLARY EMBODIMENTS

Reference will now be made in detail to exemplary embodiments, which are illustrated in the accompanying drawings. Wherever possible, the same reference numbers will be used throughout the drawings to refer to the same or like parts.

Figure 1:
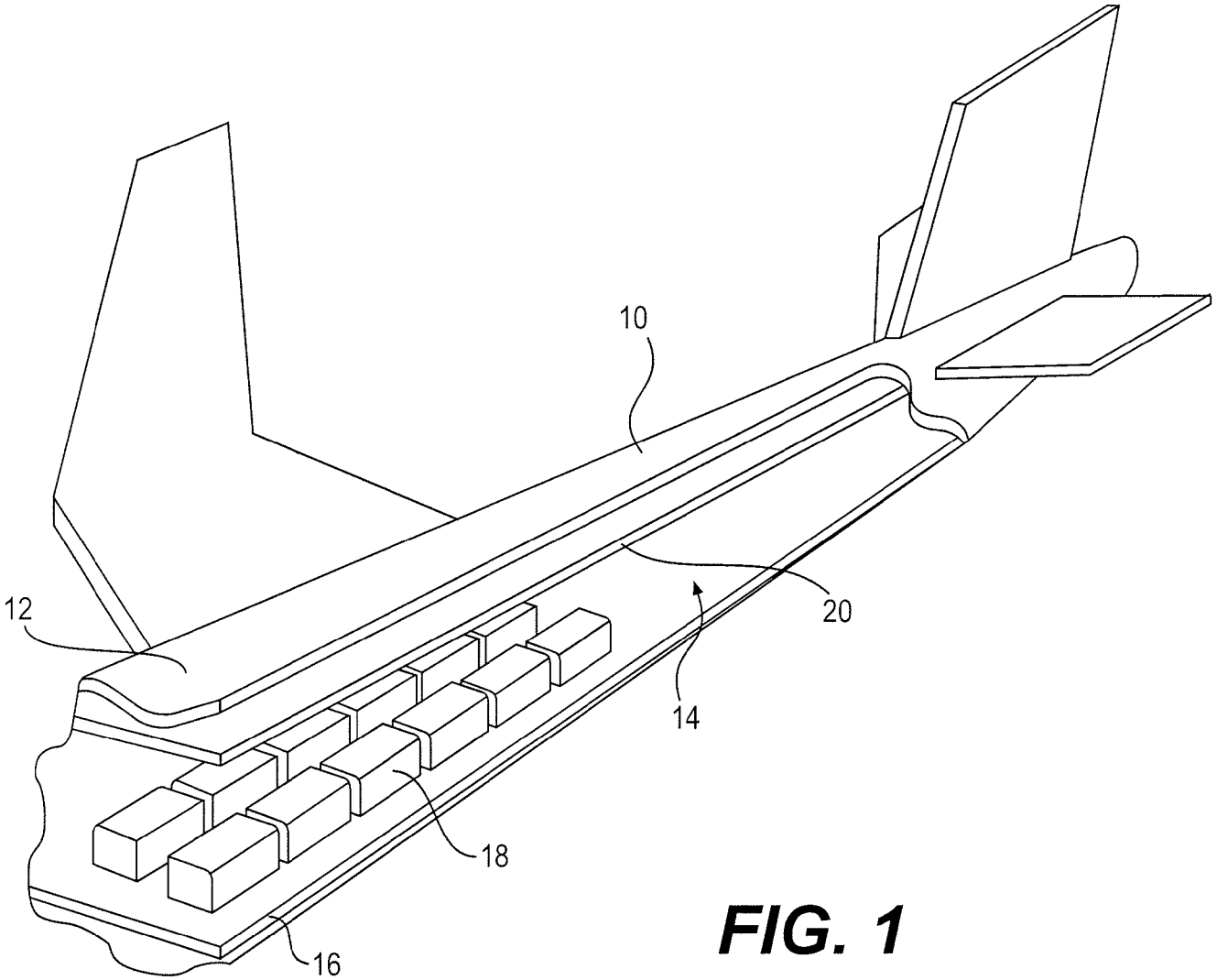
FIG. 1 is a schematic, cut-away, perspective view of an exemplary vehicle.

FIG. 1 shows an exemplary vehicle 10 for transporting containers. The vehicle 10 may include a body 12 defining an interior 14 of the vehicle, a deck 16 within the body 14, the deck 16 being configured to support a plurality of containers 18, and a ceiling 20 spaced above the deck 16.

Figure 2:
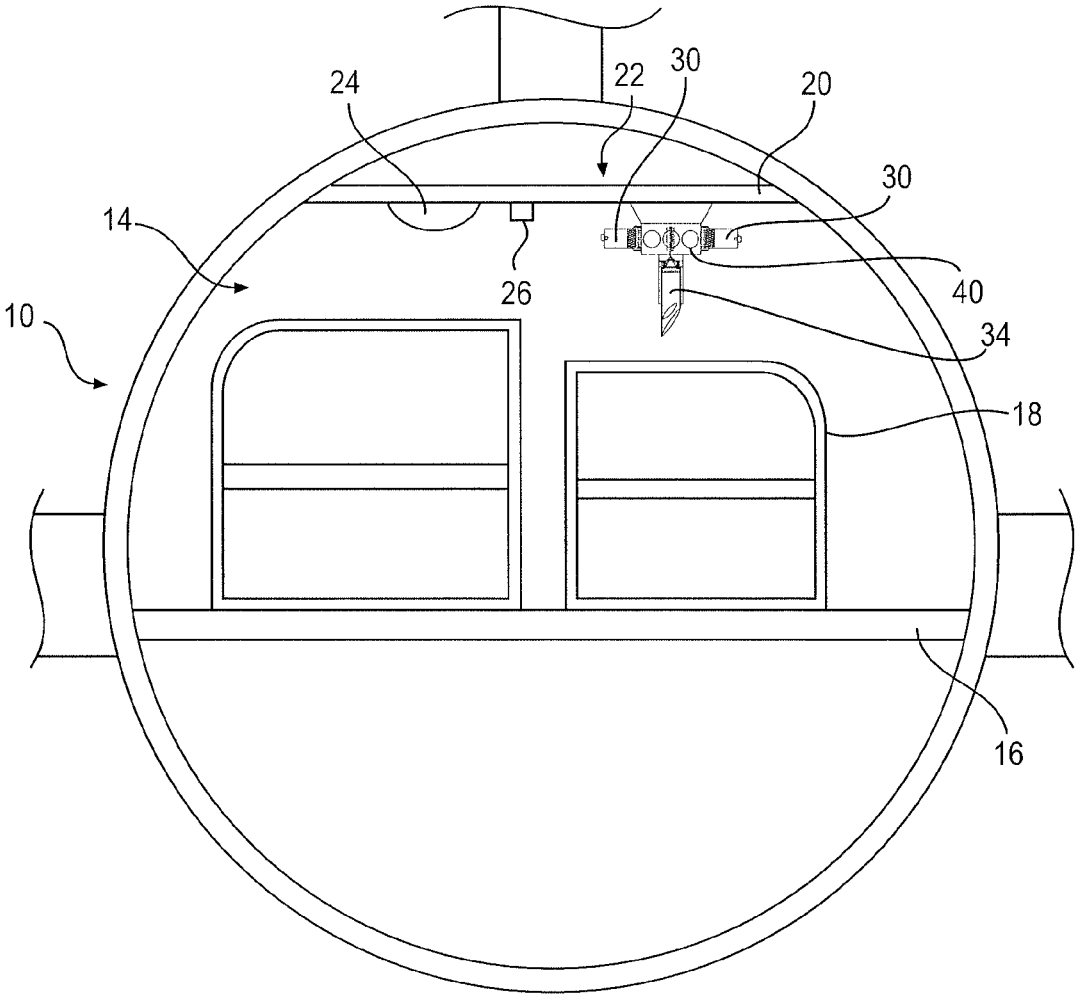
FIG. 2 is a schematic, cut-away, front view of an exemplary embodiment of a system for supplying fire suppressing agent to the interior of a container in an exemplary cargo area.

FIG. 2 is a cross-sectional view of the exemplary vehicle 10 of FIG. 1. The vehicle 10 may include a system 22 for supplying fire suppressing agent 32 (see FIG. 3) to the interior of a container 18 supported by the deck 16. The system 22 may be attached, for example, to the ceiling 20 above at least one location configured to receive a container 18. The system 22 may include a sensor 24 and a controller 26. The system 22 may further include at least two chambers 30 containing a fire suppressing agent 32, a puncture mechanism 34 with a conveyance tube 36 and a puncture tip 38 (see FIG. 5), and a manifold 40 connecting the chambers 30 to the puncture mechanism 34 that allows for flow of the fire suppressing agent 32 from a chamber 30 to the puncture mechanism 34 during operation of the system 22. In the exemplary embodiment shown, each chamber 30 is coupled to the manifold 40, for example, via a threaded screw connection 42.

The fire suppressing agent 32 may include any suitable substance or combination of substances. For example, the fire suppressing agent 32 may include, for example, a pyro-propellant configured to both generate driving pressure and provide a fire extinguishing or fire suppressing gas or aerosol. For example, the fire suppressing agent 32 may include one or more of sodium azide, 5-amino tetrazole, potassium 5-amino tetrazole, guanidine nitrate, potassium chlorate, potassium nitrate, potassium perchlorate, strontium nitrate, copper nitrate (basic), copper oxide (black), ammonium perchlorate, or a LOVA propellant. Other substances having similar characteristics are contemplated for use as the fire suppressing agent 32. Additionally, the fire suppressing agent 32 may employ byproducts of chemical reactions, such as, for example, producing potassium carbonate through a combustion reaction in the form of a finely-dispersed, micro-pulverized aerosol.

Figure 3:
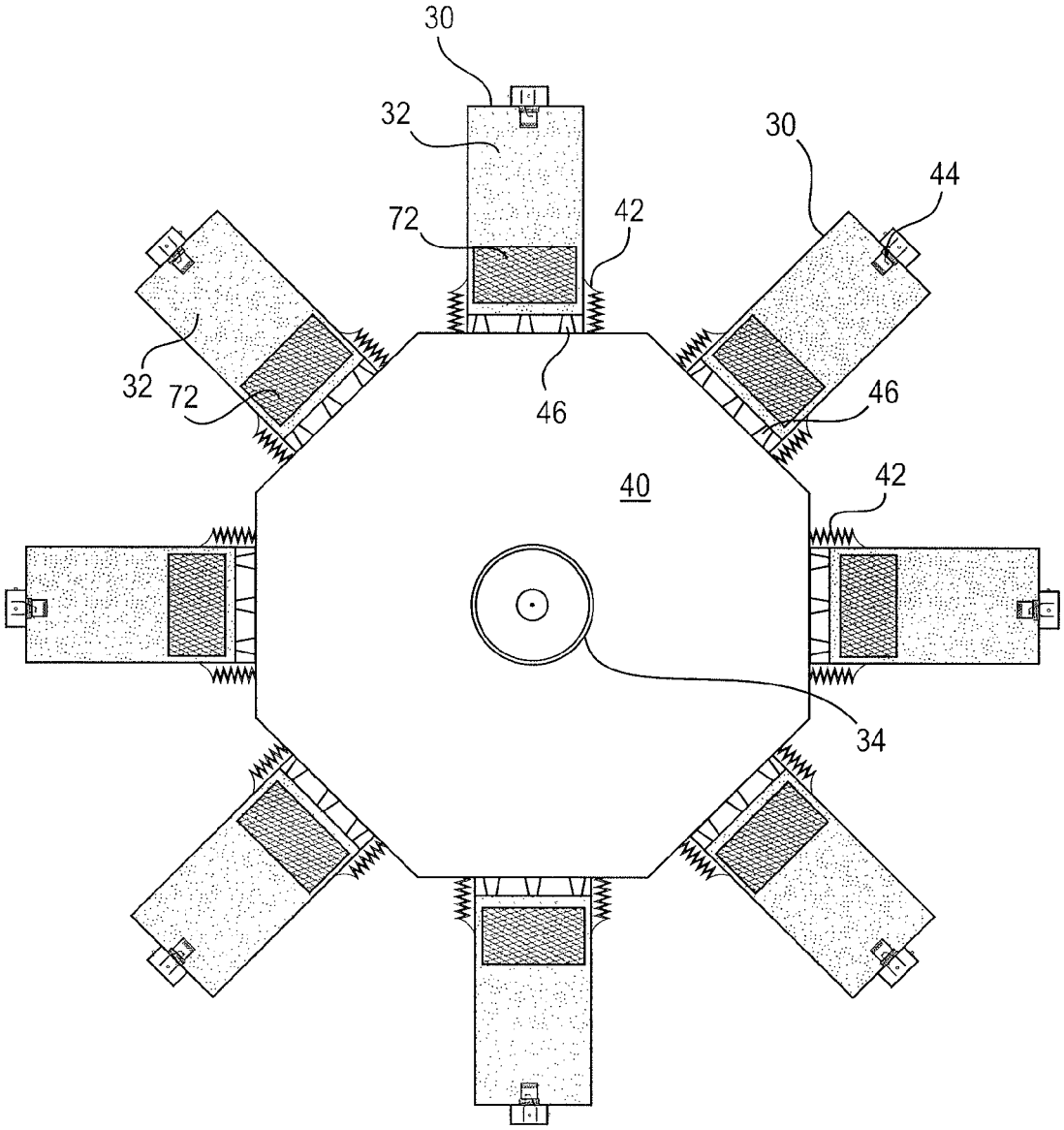
FIG. 3 is a schematic, partial cut-away, top view of an exemplary embodiment of a system for supplying fire suppressing agent to the interior of a container.

In the exemplary embodiment shown in FIG. 3, the chambers 30 are arranged about the manifold 40 in a circumferential manner. The system 22 may be configured such that only a single chamber 30 discharges a fire suppressing agent 32 into the manifold 40 at a given time. The controller 26 may be configured to control ignition of the fire suppressing agent 32 within each chamber 30 according to an ignition schedule, such that fire suppressing agent 32 may be supplied to a container 18 over an extended duration by releasing the fire suppressing agent 32 from a plurality of the chambers 30 at spaced time intervals. The activation rate of each chamber 30 and/or the discharge rate of fire suppressing agent 32 from each chamber 30 may be controlled by the controller 26. For example, the controller 26 may include a timer using fixed time intervals, a sensory input-based program, or any other suitable time-regulating mechanism.

The sensor 24 may be configured to detect undesirably high temperatures, such as from a fire within a container 18. The sensor 24 may be any suitable fire-detection mechanism, such as a thermal sensor, a smoke detector, or thermally sensitive materials. In some embodiments, the sensor 24 is in communication with the controller 26, for example, via hard-wiring and/or a wireless communication link. In the event that the sensor 24 detects a fire, such as through an elevated temperature reading or by detecting smoke, the sensor 24 is configured to send a signal detectable by the controller 26.

The controller 26 may include one or more processors, microprocessors, central processing units, on-board computers, electronic control modules, and/or any other computing and control devices known to those skilled in the art. The controller 26 may be configured to run one or more software programs or applications stored in a memory location, read from a computer-readable medium, and/or accessed from an external device operatively coupled to the controller 26 by any suitable communications network.

Figure 4:
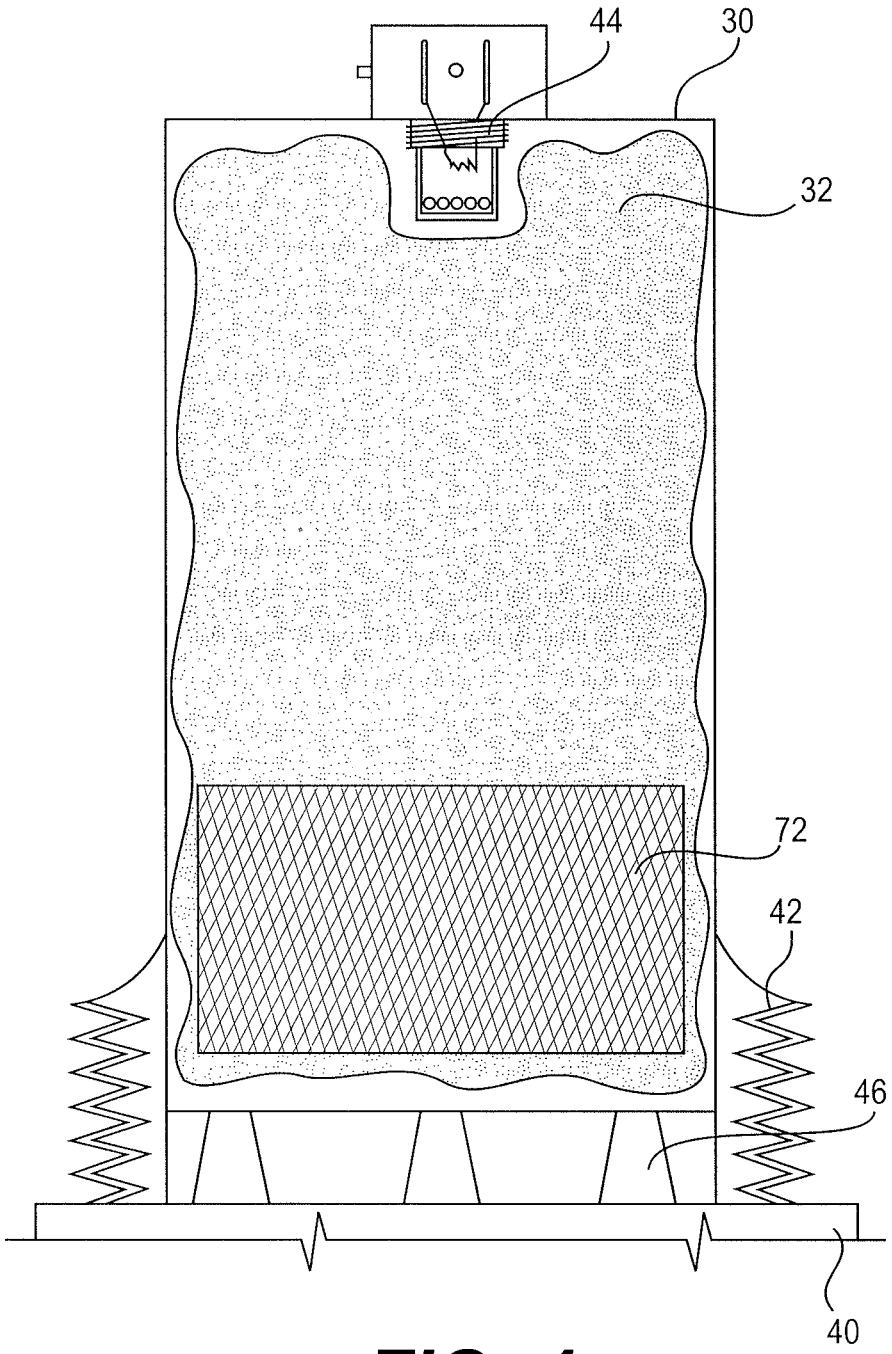
FIG. 4 is a schematic, cut-away, top view of an exemplary embodiment of a chamber containing a fire suppressing agent.

After receiving the signal from the sensor 24, the controller 26 may use any suitable means, such as software programming, mechanical components, or chemical reactions, to initiate operation of the system 22. Initiating operation may be accomplished, for example, via sending an activation signal to an igniter 44 located within a chamber 30 containing the fire suppressing agent 32, for example, as shown in FIG. 4. When exposed to heat from the igniter 44, the fire suppressing agent 32 may undergo a chemical reaction, rapidly expanding and increasing pressure within the chamber 30. According to some embodiments, following activation of the igniter 44, the controller 26 sends a signal to a reporting unit (not shown) notifying a user that the system is operating, such as to a remote flight crew within an aircraft cockpit. It is contemplated that other mechanisms and methods may be used to trigger release of fire suppressing agent 32.

Figure 5:
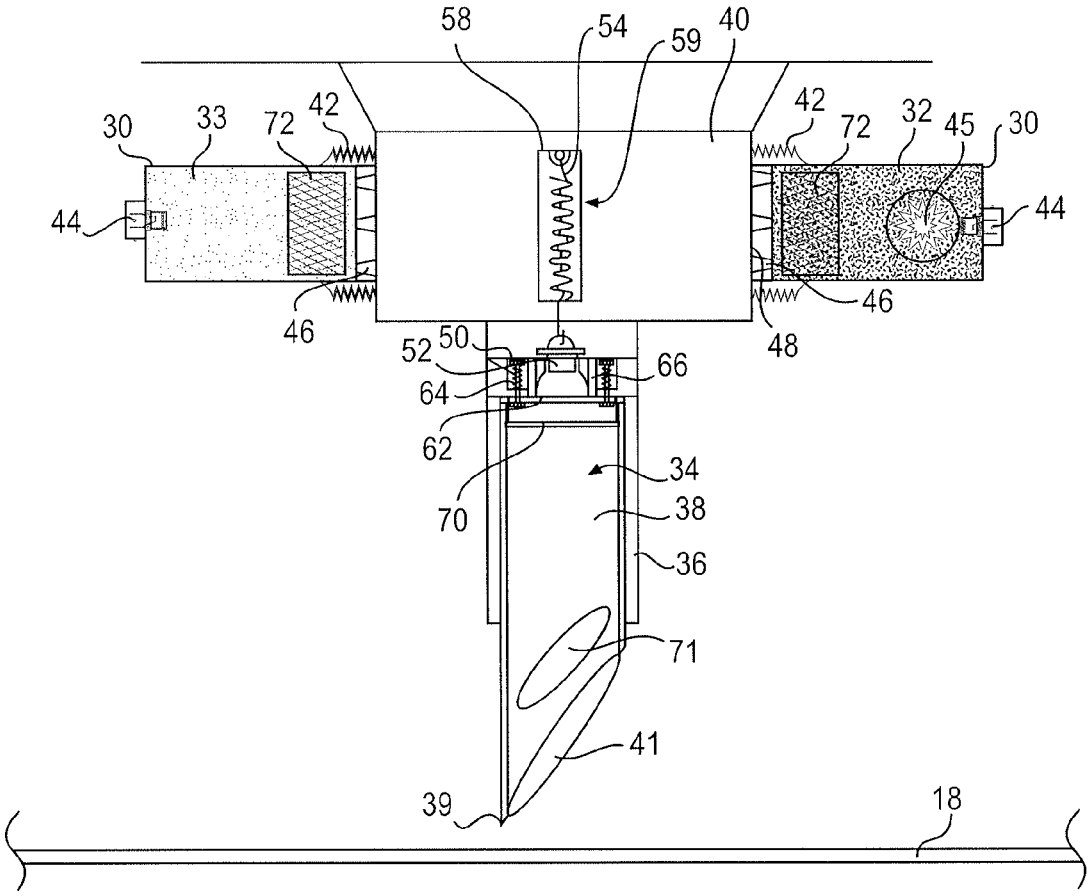
FIG. 5 is a schematic, partial cut-away, side view of an exemplary embodiment of a system for supplying fire suppressing agent to the interior of a container during operation in an initial, non-deployed configuration.
Figure 6:
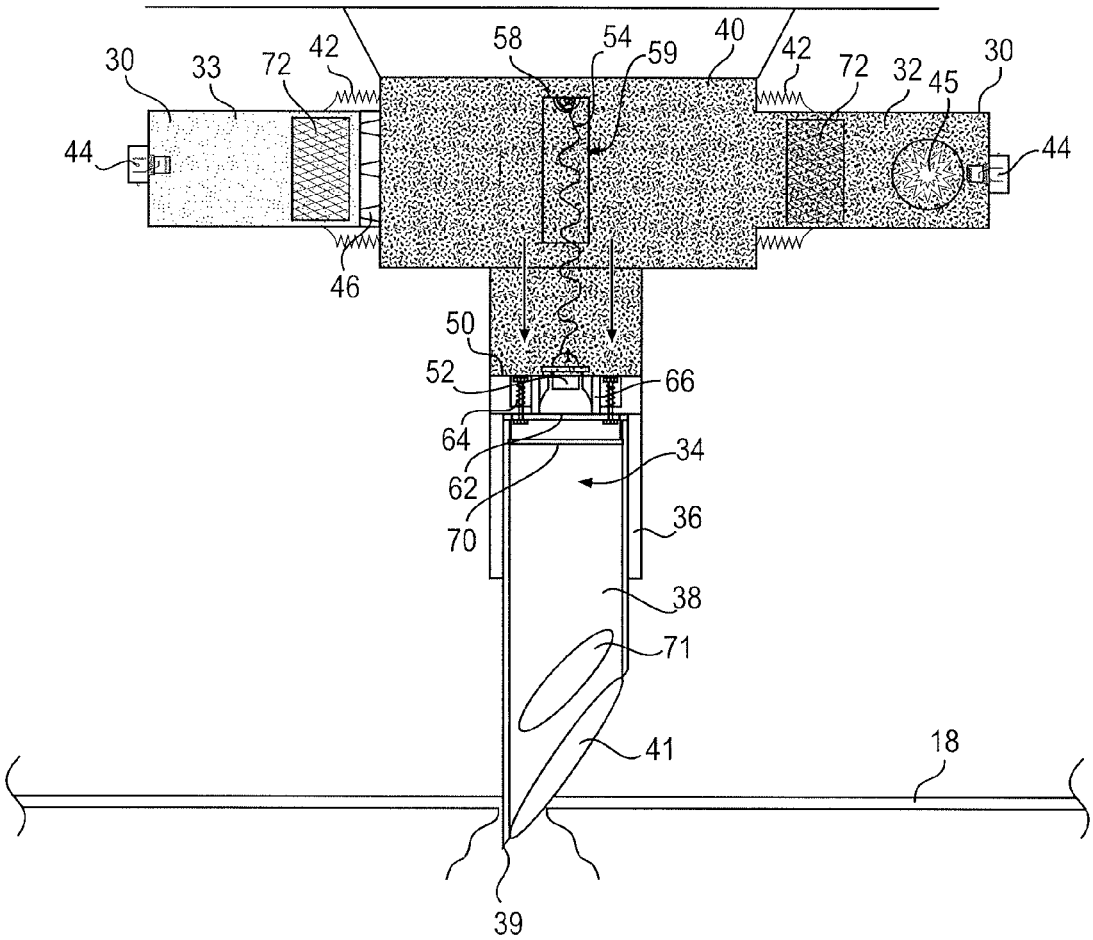
FIG. 6 is a schematic, partial cut-away, side view of an exemplary embodiment of a system for supplying fire suppressing agent to the interior of a container during operation in a partially-deployed configuration.

FIG. 5 shows an exemplary system 22 immediately following activation. Following activation of the igniter 44, which may provide, for example, an igniter flame 45 in the chamber, the fire suppressing agent 32 heats and expands within the chamber 30. One or more pressure control plugs 46 located in a passage 48 between the chamber 30 and the manifold 40 may be displaced, dislodged, or otherwise removed by pressure from the expanding fire suppressing agent 32. (To illustrate the presence and flow of the expanding fire suppressing agent 32, a darker shade is used in FIGS. 5-7 for the activated fire suppressing agent 32 than for unactivated fire suppressing agent 33 in an unactivated chamber 30). The pressure control plug 46 may be formed from any suitable material as long as it prevents external pressure and heat from affecting an inactive chamber 30 (i.e., while the system is not activated). As shown in FIG. 6, once a pressure control plug 46 is dislodged, the chamber 30 may be placed in flow communication with the manifold 40, and the fire suppressing agent 32 may flow out of the chamber 30 and into the manifold 40. The fire suppressing agent 32 may continue to expand while pressurizing the interior space of the manifold 40.

FIG. 6 shows the fire suppressing agent 32 as it expands within the manifold 40, further exerting force upon a pressure disk 50 located at the interface between the manifold 40 and the puncture mechanism 34. (Arrows are used in FIGS. 6-8 to schematically indicate the flow of the fire suppressing agent 32.) The force exerted upon the pressure disk 50 may cause the puncture tip 38, initially located in a retracted position within a conveyance tube 36 of the puncture mechanism 34, to extend along the conveyance tube 36. The puncture tip 38 may include an angled piercing edge 39, a puncture tip opening 41, and a puncture tip side port 71. The puncture tip 38 may extend to a certain point, such as until the puncture tip 38 reaches one or more guide stops (not shown) on the conveyance tube 36. When the puncture tip 38 strikes the container 18, pressure may continue to build up on the pressure disk 50 as a result of the expanding fire suppressing agent 32, which may increase the force upon the puncture tip 38 through the pressure disk 50, thereby causing the puncture tip 38 to penetrate an exterior wall of a container 18.

In some embodiments, the conveyance tube 36 further includes a locking mechanism (not shown) that locks the puncture tip 38 at its furthest-traveled position, thereby preventing the puncture tip 38 from contacting an object and bouncing back into the conveyance tube 36. The locking mechanism maximizes the likelihood of successful container 18 penetration, minimizing the possible waste of fire suppressing agent 32 during operation of the system 22.

Figure 7:
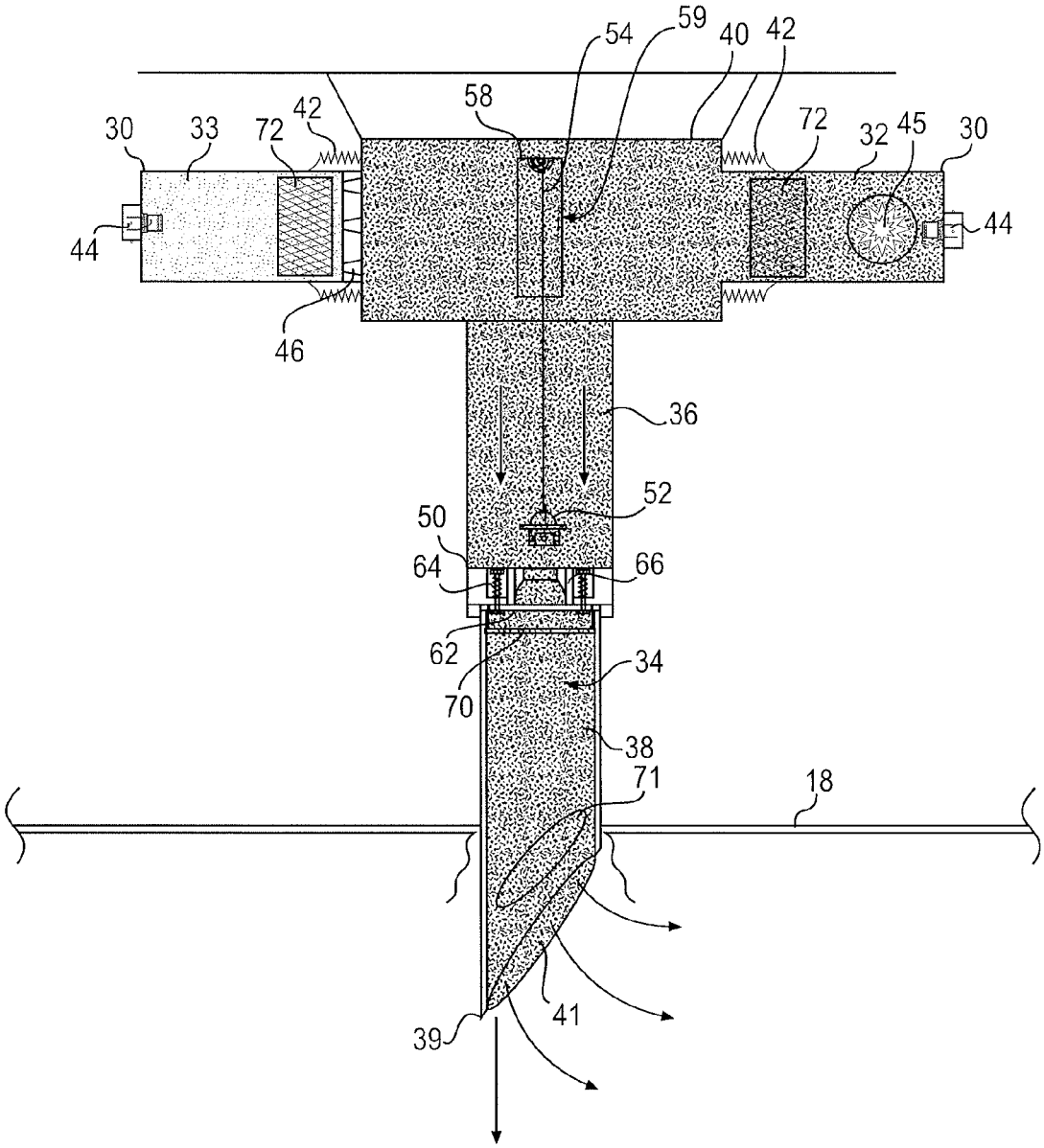
FIG. 7 is a schematic, partial cut-away, side view of an exemplary embodiment of a system for supplying fire suppressing agent to the interior of a container during operation in a fully-deployed configuration.
Figure 8:
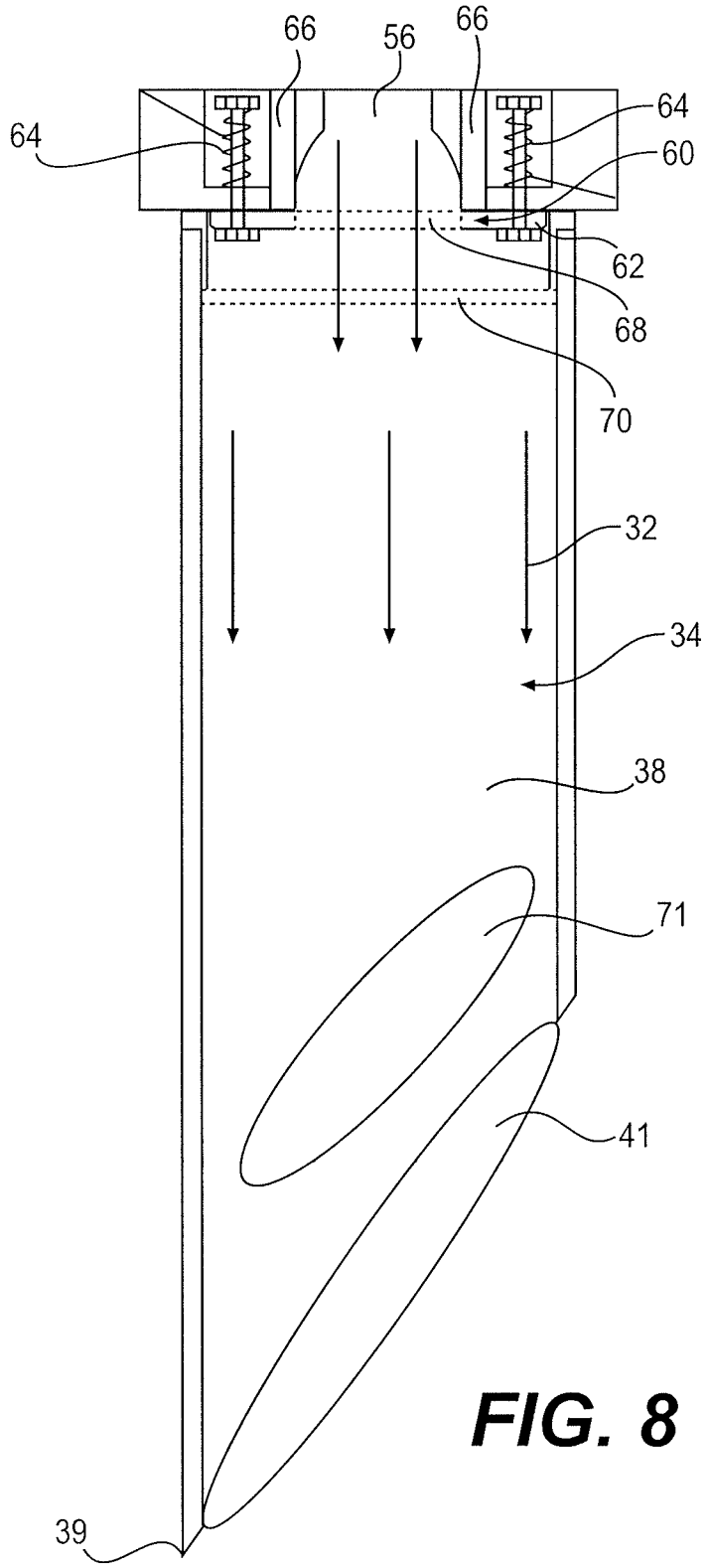
FIG. 8 is a schematic, partial cut-away, side view of an exemplary embodiment of a puncture mechanism during operation with an exemplary pressure plug removed.

As shown in FIGS. 7 and 8, as the puncture tip 38 translates along the extent of the conveyance tube 36, but before the puncture tip 38 reaches its maximum extension, a pressure plug 52 located on the pressure disk 50 may be displaced by a pressure plug cable 54 fastened to the interior of the manifold 40. Displacement of the pressure plug 52 exposes an orifice 56 within the pressure disk 50 that allows the fire suppressing agent 32 to flow from the manifold 40 to the conveyance tube 36 through the orifice 56. The puncture tip 38 penetrates the skin of a container 18 before the pressure plug 52 is displaced from the pressure disk 50, thereby allowing the fire suppressing agent 32 to flow through the conveyance tube 36 and into the interior of the container 18 through the puncture tip opening 41 and/or the puncture tip side port 71. (The flow of fire suppressing agent 32 through the conveyance tube 36 is shown with schematic arrows in FIG. 8).

Figure 9:
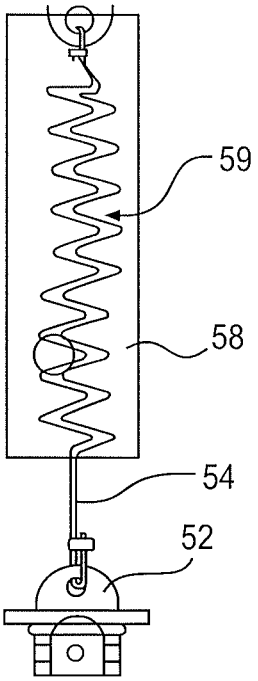
FIG. 9 is a schematic, partial cut-away, side view of an exemplary embodiment of a pressure plug assembly in a non-extended configuration.
Figure 10:
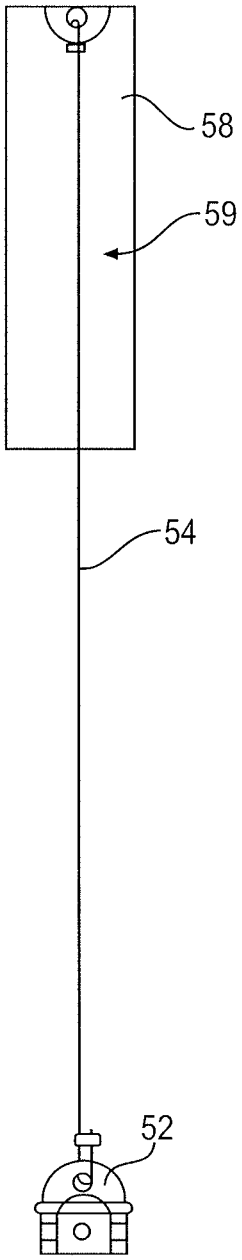
FIG. 10 is a schematic, partial cut-away, side view of an exemplary embodiment of a pressure plug assembly in a fully-extended configuration.

In the exemplary embodiment shown in FIG. 9, the pressure plug cable 54 may be initially coiled within a pressure plug cable sleeve 58 located within the manifold 40. The pressure plug cable sleeve 58 protects the pressure plug cable 54 from damage or deformation during the initial expansion of the fire suppressing agent 32 within the manifold 40. The pressure plug 52 is displaced by the pressure plug cable 54 when the pressure plug cable 54 reaches its full extension, such as when the puncture tip 38 translates within the conveyance tube 36 away from the manifold 40 to a certain distance from the manifold 40. An exemplary embodiment of a fully-extended pressure plug cable 54 attached to a pressure plug 52 is shown in FIG. 10. The pressure plug cable 54 may be made of any suitable material, such as stainless steel or other materials having similar characteristics. Collectively, the pressure plug 52, pressure plug cable 54, and pressure plug cable sleeve 58 form a pressure plug assembly 59.

Pressure may mount within the manifold 40 and/or chamber 30 if the puncture tip 38 does not translate far enough within the conveyance tube 36 to displace the pressure plug 52 from the pressure disk 50 via the pressure plug cable 54. To alleviate such pressure before it causes damage to the manifold 40 and/or chamber 30, the pressure disk 50 may further include an emergency pressure release valve 60.

Figure 11:
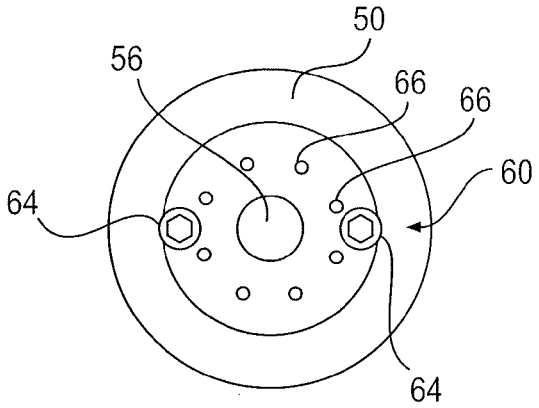
FIG. 11 is a schematic, top view of an exemplary embodiment of a puncture mechanism.
Figure 12:
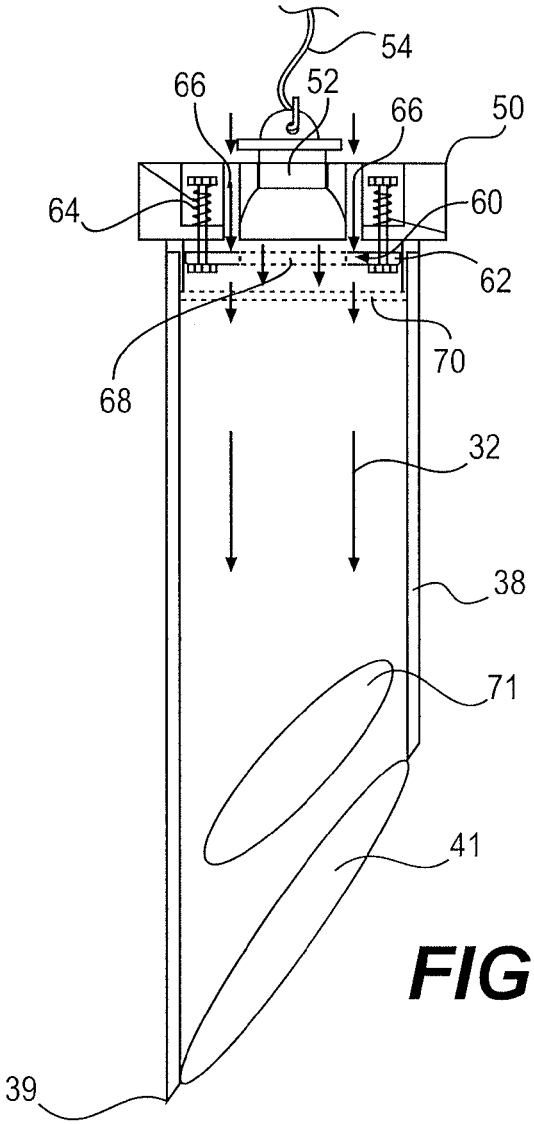
FIG. 12 is a schematic, partial cut-away, side view of an exemplary embodiment of a puncture mechanism during operation with an exemplary pressure plug.

In the exemplary embodiments shown in FIGS. 11 and 12, the emergency pressure release valve 60 on the pressure disk 50 may include a pressure plate 62, springs 64, and ports 66. The ports 66 of the emergency pressure valve 60 may allow the fire suppressing agent 32 to bypass the orifice 56 that would otherwise be exposed by displacement of the pressure plug 52, and the fire suppressing agent 32, through the ports 66, may then exert pressure upon the pressure plate 62. In the exemplary embodiments shown, the pressure plate 62 is connected to the pressure disk 50 by springs 64, and includes a pressure plate orifice 68 in the center of the pressure plate 62 configured to allow the fire suppressing agent 32 to flow through the pressure plate 62 without impediment upon removal of the pressure plug 52 by the pressure plug cable 54. The pressure plate 62 may block the flow of any fire suppressing agent 32 traveling through the ports 66 if the pressure plug 52 remains in place, however, until the pressure from the fire suppressing agent 32 in the ports 66 directed against the pressure plate 62 exerts sufficient force to displace the pressure plate 52.

The strength of the springs 64, which dictates the force required for displacement of the pressure plate 62, may be determined, for example, by considering the critical system pressure and a factor of safety, and may be selected to permit the pressure plate 62 to separate from the pressure disk 50 prior to any pressure damage occurring to the manifold 40 or chambers 30. In the exemplary embodiment shown in FIG. 12, when the fire suppressing agent 32 within the manifold 40 exerts sufficient pressure against the pressure plate 62 and stretches the springs 64, thereby displacing the pressure plate 62, the fire suppressing agent 32 enters the conveyance tube 36 through the pressure plate orifice 68, even if the puncture tip 38 is not fully extended. (The flow of the fire suppressing agent 32 is schematically shown with arrows). The use of springs 64 is exemplary, and the pressure plate 62 may be displaced by alternative mechanisms, such as valves or electrical pressure transducers (not shown).

Figure 13:
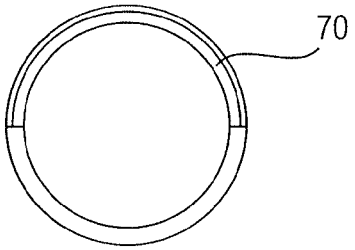
FIG. 13 is a schematic, top view of an exemplary embodiment of a removable puncture tip.
Figure 14:
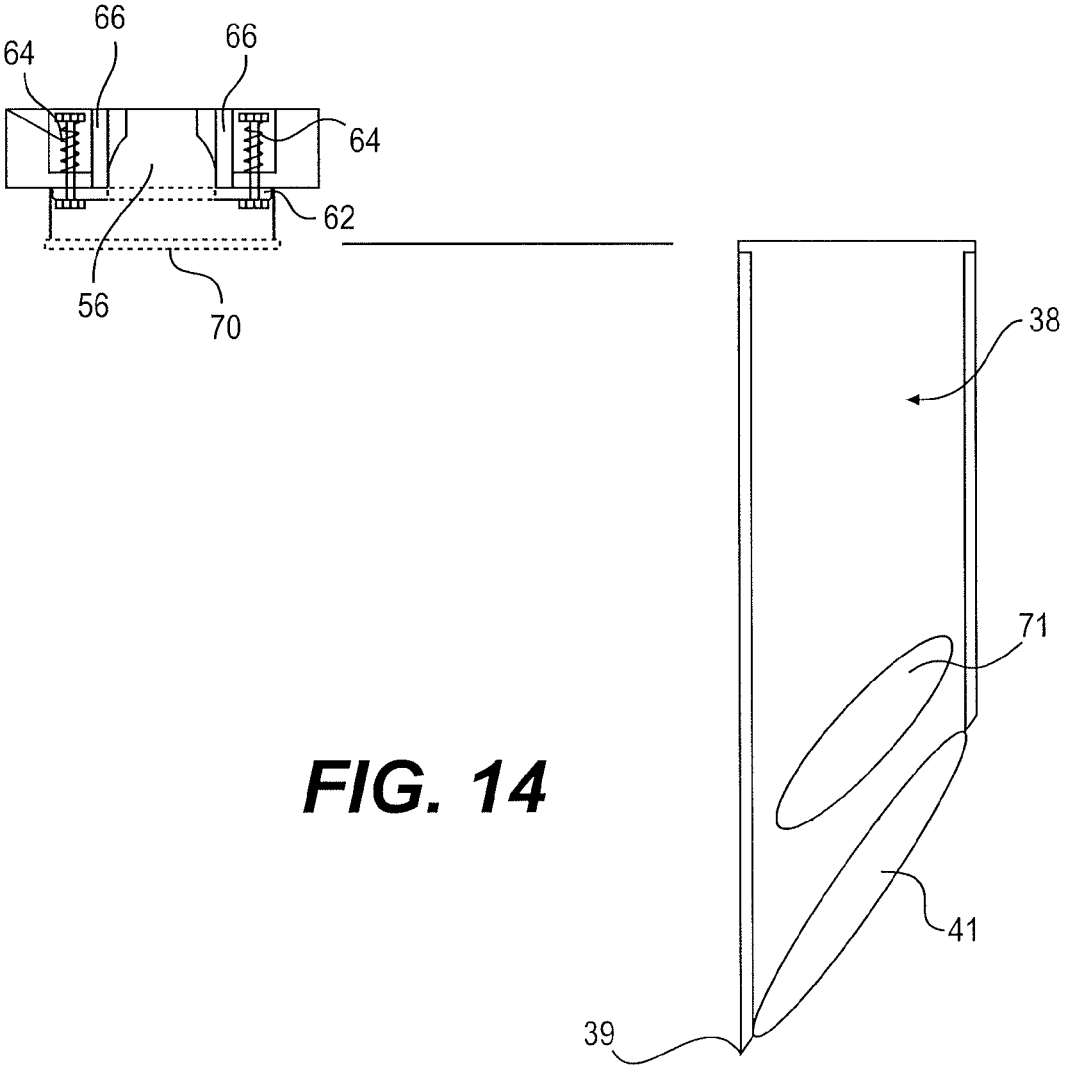
FIG. 14 is a schematic, partial cut-away, side view of an exemplary embodiment of a removable puncture tip.

In the exemplary embodiments shown in FIGS. 13 and 14, the puncture mechanism 34 may further include a puncture tip disconnect 70 that allows for easy removal of the puncture tip 38 from the conveyance tube 36 after operation of the system 22. The puncture tip disconnect 70 may allow the puncture tip 38, for example, to remain in the container 18 following penetration of the container 18 until the puncture tip 38 can be safely removed during inspection.

The system 22 may further include a heat sink 72 configured to cool the fire suppressing agent 32 after ignition and before the fire suppressing agent 32 enters one or more of the manifold 40, puncture mechanism 34, and container 18. The heat sink 72 may be formed from any suitable material in an arrangement with high surface area and high thermal conductivity, such as, for example, a series of baffles or an array of fins. The heat sink 72 may be provided in one or more of the chamber 30, manifold 40, or conveyance tube 36.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A device for supplying fire suppressing agent to the interior of a container for an extended duration, the device comprising:

a plurality of chambers configured to contain and selectively expel the fire suppressing agent;

a puncture mechanism configured to puncture a container comprising a conveyance tube and a puncture tip associated with the conveyance tube;

a manifold in flow communication with the plurality of chambers and the puncture mechanism; and a controller configured to initiate expulsion of the fire suppressing agent from the chambers in a controlled manner, wherein the device is configured such that the fire suppressing agent is expelled from a first one of the plurality of chambers at a first time, wherein the conveyance tube and the puncture tip are configured such that the puncture tip translates relative to the conveyance tube away from the manifold to puncture the container, thereby providing flow communication between the conveyance tube and the interior of the container, wherein the puncture mechanism further comprises a pressure disk coupled to the puncture tip, the pressure disk being configured to transfer force from the fire suppressing agent after expulsion from the chambers to the puncture tip, thereby inducing the puncture tip to translate relative to the conveyance tube away from the manifold, wherein the pressure disk further comprises an emergency pressure release valve, and wherein the device is configured such that the fire suppressing agent is expelled from a second one of the plurality of chambers at a second time later than the first time.

2. The device of claim 1, wherein the conveyance tube further comprises a guide stop configured to limit a maximum distance that the puncture tip translates relative to the conveyance tube.

3. The device of claim 1, wherein the conveyance tube further comprises a locking mechanism configured to secure the puncture tip at a maximum remote position relative to the manifold.

4. The device of claim 1, wherein the pressure disk comprises an aperture and a pressure plug received in the aperture, wherein the pressure plug is configured to release from the aperture upon extension of the puncture tip, thereby placing the manifold in flow communication with the interior of the container.

5. The device of claim 4, wherein the pressure plug is coupled to a pressure plug cable having a length shorter than a maximum distance that the puncture tip translates relative to the conveyance tube, and wherein the pressure plug cable is coupled to the pressure plug and the manifold, such that the pressure plug is configured to separate from the aperture upon extension of the pressure plug cable.

6. The device of claim 1, wherein the emergency pressure release valve comprises a pressure plate, at least one spring coupling the pressure plate to the pressure disk, and at least one port in the pressure disk.

7. The device of claim 1, wherein the emergency pressure release valve is configured to be actuated by electrical pressure transducers.

8. The device of claim 1, wherein each of the chambers includes an initiator configured to initiate expulsion of the fire suppressing agent from the respective chamber.

9. The device of claim 8, wherein the initiators comprise an igniter configured to initiate expansion of the fire suppressing agent in the respective chambers, and wherein the igniter is configured to be controlled by at least one of a computer with software programming, at least one mechanical component, and at least one chemical reaction.

10. The device of claim 1, wherein each of the chambers comprises an orifice and a control plug received in the orifice, wherein the control plug and orifice are configured such that the control plug separates from the orifice when pressure inside the respective chamber is sufficient to separate the control plug from the orifice, thereby providing flow communication between the respective chamber and the manifold.

11. The device of claim 1, wherein at least one of the chambers, the manifold, and the puncture mechanism includes a heat exchanger configured to reduce the temperature of the fire suppressing agent upon expulsion.

12. The device of claim 11, wherein the heat exchanger comprises at least one of a baffle and an array of fins.

13. The device of claim 1, wherein the puncture mechanism comprises a puncture tip disconnect configured to facilitate removal of the puncture tip from the conveyance tube.

14. The device of claim 1, wherein the device comprises from two to ten chambers.

15. The device of claim 14, wherein the chambers are circumferentially arranged about the manifold.

16. The device of claim 14, wherein the controller is configured to initiate expulsion of the fire suppressing agent in a sequential manner from two or more of the plurality of chambers.

17. A system for supplying fire suppressing agent to the interior of a container for an extended duration, the system comprising:

a plurality of chambers configured to contain and selectively expel the fire suppressing agent;

a puncture mechanism configured to puncture a container comprising a conveyance tube and a puncture tip associated with the conveyance tube;

a manifold in flow communication with the plurality of chambers and the puncture mechanism; and a sensor configured to provide signals indicative of a temperature associated with a container to a controller configured to initiate expulsion of the fire suppressing agent from the chambers in a controlled manner, wherein the system is configured such that the fire suppressing agent is expelled from a first one of the plurality of chambers at a first time, wherein the system is configured such that the fire suppressing agent is expelled from a second one of the plurality of chambers at a second time later than the first time, wherein the conveyance tube and the puncture tip are configured such that the puncture tip translates relative to the conveyance tube away from the manifold to puncture the container after expulsion of the fire suppressing agent, thereby providing flow communication between the conveyance tube and the interior of the container, wherein the puncture mechanism further comprises a pressure disk coupled to the puncture tip, the pressure disk being configured to transfer force from the fire suppressing agent after expulsion from the chambers to the puncture tip, thereby inducing the puncture tip to translate relative to the conveyance tube away from the manifold, and wherein the pressure disk further comprises an emergency pressure release valve.

18. The system of claim 17, wherein the sensor comprises at least one of a thermal sensor, a smoke detector, and a thermally sensitive material.

19. The system of claim 17, wherein the controller comprises at least one of a processor, microprocessor, central processing unit, on-board computer, and electronic control modules.

20. The system of claim 17, further comprising an alerting system configured to send signals indicating activation of the system to a location remote from the container.

21. The system of claim 20, wherein the location remote from the container comprises an aircraft cockpit.

22. The system of claim 17, wherein the pressure disk comprises an aperture and a pressure plug received in the aperture, wherein the pressure plug is configured to release from the aperture upon extension of the puncture tip, thereby placing the manifold in flow communication with the interior of the container.

23. A device for supplying fire suppressing agent to the interior of a container for an extended duration, the device comprising:

a plurality of chambers configured to contain and selectively expel the fire suppressing agent;

a puncture mechanism configured to puncture a container comprising a conveyance tube and a puncture tip associated with the conveyance tube;

a manifold in flow communication with the plurality of chambers and the puncture mechanism; and a controller configured to initiate expulsion of the fire suppressing agent from the chambers in a controlled manner, wherein the device is configured such that the fire suppressing agent is expelled from a first one of the plurality of chambers at a first time, wherein the conveyance tube and the puncture tip are configured such that the puncture tip translates relative to the conveyance tube away from the manifold to puncture the container, thereby providing flow communication between the conveyance tube and the interior of the container, wherein the puncture mechanism further comprises a pressure disk coupled to the puncture tip, the pressure disk being configured to transfer force from the fire suppressing agent after expulsion from the chambers to the puncture tip, thereby inducing the puncture tip to translate relative to the conveyance tube away from the manifold, wherein the pressure disk comprises an aperture and a pressure plug received in the aperture, wherein the pressure plug is configured to release from the aperture upon extension of the puncture tip, thereby placing the manifold in flow communication with the interior of the container, and wherein the device is configured such that the fire suppressing agent is expelled from a second one of the plurality of chambers at a second time later than the first time.

* * * * *